US005205059A

United States Patent [19]

Doll

[11] Patent Number: 5,205,059

[45] Date of Patent: Apr. 27, 1993

[54] DISPLAY FRAME AND PROTECTIVE CONTAINER

[76] Inventor: Jacob G. Doll, 23 Terrance Dr., Batesville, Ind. 47006

[21] Appl. No.: 830,115

[22] Filed: Jan. 31, 1992

[51] Int. Cl.[5] ..... G09F 1/12

[52] U.S. Cl. ..... 40/152; 403/375; 403/380

[58] Field of Search ..... 40/152, 156, 158.1, 40/152.1, 27.5, 159.2; 403/375, 380; 206/449, 472, 38; 220/355

[56] References Cited

U.S. PATENT DOCUMENTS

| | | | |
|---|---|---|---|
| 2,137,156 | 11/1938 | Clark . | |
| 2,747,311 | 5/1954 | Fulmer . | |
| 2,820,310 | 1/1958 | John . | |
| 2,919,512 | 1/1960 | McDonald . | |
| 3,009,275 | 11/1960 | Rosenberg . | |
| 3,408,759 | 11/1968 | Rotheraine et al. . | |
| 3,694,949 | 10/1972 | Howe | 40/301 |
| 4,158,266 | 6/1979 | Gilmour | 40/152 |
| 4,259,381 | 3/1981 | Narita | 40/124.5 |
| 4,787,527 | 11/1988 | Monetti | 220/355 X |
| 4,848,014 | 7/1989 | Yesbick | 40/124.5 |
| 4,918,299 | 4/1990 | Ohmori | 206/449 X |
| 4,979,619 | 12/1990 | Hager | 40/156 X |

*Primary Examiner*—Kenneth J. Dorner
*Assistant Examiner*—J. Bonifanti
*Attorney, Agent, or Firm*—Frost & Jacobs

[57] ABSTRACT

A display frame having a transparent viewing area comprising a face plate and a back plate provided with a tongue and groove engagement when assembled, adhesive material in the groove whereby to form a sealed chamber within which a picture and/or indicia are displayed, and a desiccant material in communication with the sealed chamber, thereby providing indefinite protection against moisture and dust.

12 Claims, 6 Drawing Sheets

DISPLAY FRAME AND PROTECTIVE CONTAINER

BACKGROUND OF THE INVENTION

1. Field of the Invention

This invention relates to a display frame for pictures, printed indicia and the like which protects against the adverse effects of ultraviolet light, moisture and dust. Although not so limited, the invention has special utility as a memorial for a deceased person, which could be prepared by a funeral director or family member, providing indefinite preservation of a photograph of the deceased and his or her vital statistics. Preferably the display frame provides viewing areas both on the front and back sides thereof.

2. Prior Art

U.S. Pat. No. 4,848,014, issued Jul. 18, 1989, to J. Yesbick, discloses a frame assembly comprising a unitary front frame having a viewing area surrounded by an opaque border, a first recess centrally located in the rear of the front frame, a second recess formed in the rear of the front frame with a sealing rib on each side of the second recess; and a backing plate having first and second planar surfaces with adhesive means attached to each of the first and second surfaces and protective peel-off tape covering the adhesive means. A picture or indicia is attached to the first surface of the backing plate after the peel-off tape is removed, and the first surface may then be inserted into the first recess of the front frame. After removal of the peel-off tape from the second surface, it is placed against the sealing ribs of the front frame to provide a surface seal on each side of the second recess.

U.S. Pat. No. 3,694,947 issued Oct. 3, 1972, to K. Mukai et al, discloses a picture frame having an at least partially transparent face plate with two opposed edges bent backward at an acute angle to form substantially straight flanges, and a back plate dimensioned to fit against the rear of the face plate. The back plate also has two opposed notched edges bent backwardly to form flanges fitting between the flanges of the face plate, the angularities of the flanges being such that the flanges of the face plate compress inwardly the flanges of the back plate and grip an object placed between the two plates.

U.S. Pat. No. 3,408,759, issued Nov. 5, 1968, to J. Rotheraine et al, discloses a picture frame having a viewing opening, a marginal portion surrounding the opening being recessed at the rear face of the frame, a backing and a transparent member (between which a picture is placed) inserted in the recess, the frame having flanges overhanging the backing, the marginal portion at the front face of the frame having a rounded bead and an insert recessed to receive the bead and having a rearwardly extending flange which engages the inner marginal recess.

U.S. Pat. No. 2,747,311, issued May 29, 1956, to N. Fulmer, discloses a display frame one embodiment of which provides a front window having convex side edges which snap into concave surfaces on parallel ribs which extend forwardly from a back window. Both the front and back windows may be transparent.

Other patents relating generally to display frames, easels and the like include:

U.S. Pat. No. 3,009,275, issued Nov. 21, 1961, to H. Rosenberg.

U.S. Pat. No. 2,919,512, issued Jan. 5, 1960, to A. McDonald.

U.S. Pat. No. 2,820, 310, issued Jan. 21, 1958, to F. John.

U.S. Pat. No. 2,137,156, issued Nov. 15, 1938, to C. Clark.

To the best of applicant's knowledge, there appears to be no suggestion in the prior art of a display frame having permanently adhered mating face and back plates to form a hermetically sealed space or chamber within which a picture and/or indicia can be displayed, with desiccant material in communication with the sealed space, thereby providing protection against moisture and dust.

SUMMARY OF THE INVENTION

It is a principal object of the invention to provide a display frame having permanently adhered mating face and back plates which form a hermetically sealed chamber within which a picture and/or indicia may be displayed, with desiccant material in communication with the sealed chamber, and having at least one transparent viewing area resistant to passage of ultraviolet light, thereby providing protection against adverse effects of ultraviolet light, moisture and dust.

It is a further object of the invention to provide a protective container for the display frame having a vacuum seal closure, the container being formed of a vinyl resin having a suede-like finish and being dimensioned to hold at least one display frame. Other materials can be stored in the container, such as documents, certificates and the like.

According to the invention there is provided a display frame comprising a planar face plate and having a transparent viewing area extending over a major portion thereof and a side edge extending rearwardly substantially perpendicular to said face plate, a continuous flange secured to said face plate and extending rearwardly substantially perpendicular thereto, said flange being spaced inwardly of said side edge and parallel thereto whereby to form a groove around the entire periphery of the rear side of said face plate; a planar back plate having the same dimensions as said face plate and having a continuous tongue extending forwardly substantially perpendicular to said back plate, said tongue being spaced inwardly from the edge of said back plate a distance sufficient to provide a mating tongue and groove engagement around the entire periphery of said display frame when said face plate and said back plate are placed in assembled relation; adhesive material positioned in said groove whereby to form a sealed chamber directly behind said viewing area when said face plate and back plate are in assembled relation; and a desiccant material in communication with said sealed chamber.

Preferably the display frame includes a second transparent viewing area extending over a major portion of the back plate. Spacer means is also provided in the preferred practice for the purpose of holding a picture in contact with the viewing area of the face plate and holding a picture or indicia in contact with the viewing area of the back plate within the sealed chamber and surrounding the desiccant material when the face plate and back plate are placed in assembled relation.

BRIEF DESCRIPTION OF THE DRAWINGS

Reference is made to the accompanying drawings wherein.

DETAILED DESCRIPTION OF THE INVENTION

Figure 1:
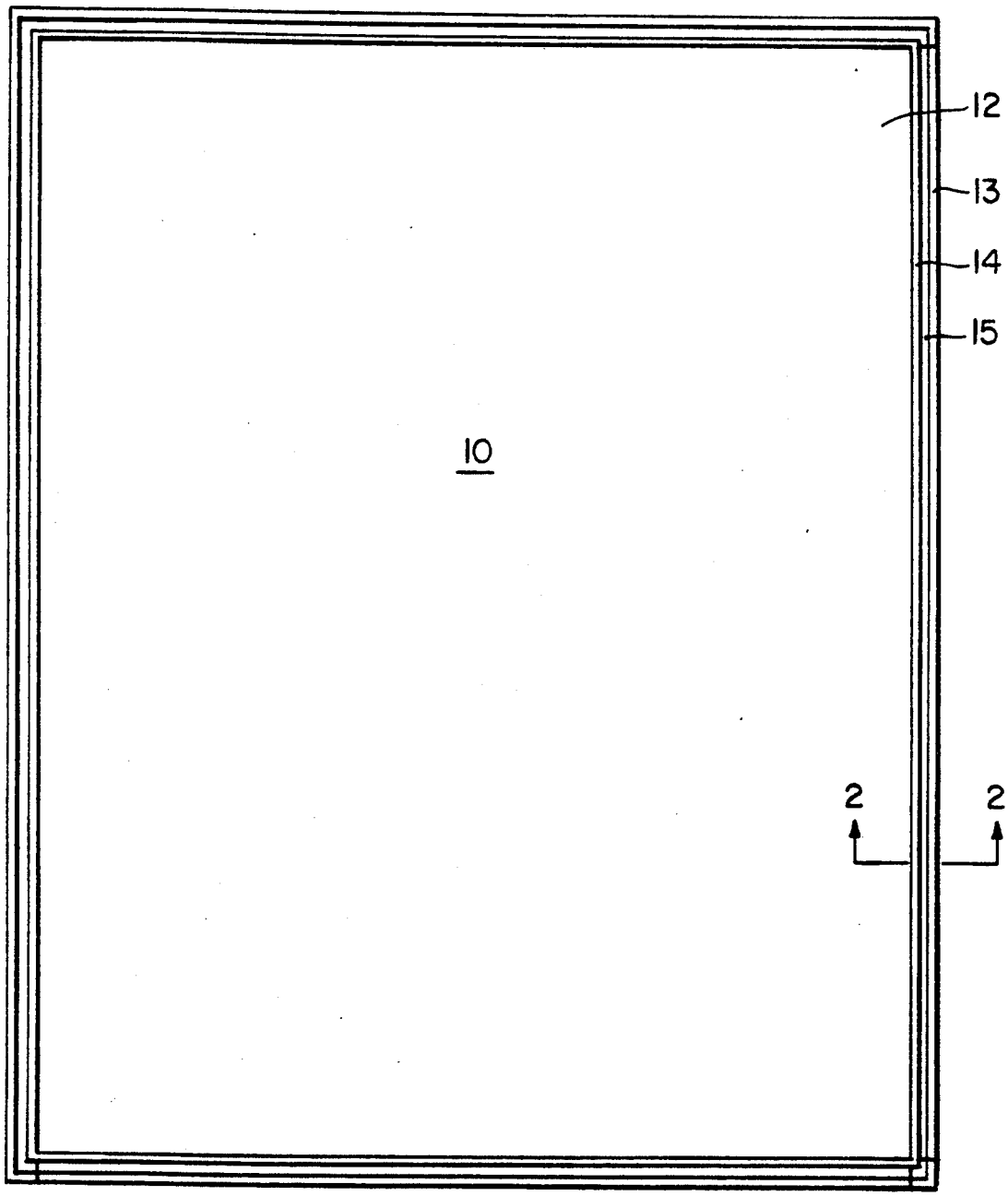
FIG. 1 is a rear view of a face plate embodying the invention.
Figure 2:
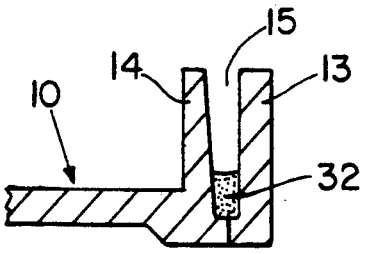
FIG. 2 is a fragmentary sectional view taken along the line 2—2 of FIG. 1.
Figure 3:
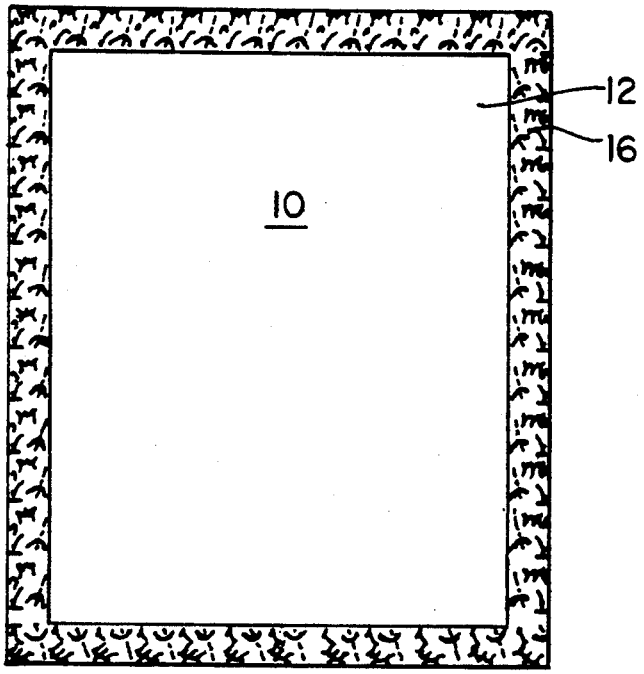
FIG. 3 is a front view of a face plate in accordance with the invention.

Referring to FIGS. 1-3, a planar face plate is indicated generally at 10. A planar back plate in accordance with the invention is indicated generally at 11 in FIGS. 4-6.

In the exemplary embodiment shown in the drawings the display frame is rectangular. However, it is to be understood that the frame may be square, oval or other regular geometric configuration.

Face plate 10 comprises a planar transparent viewing area 12, a side edge 13 extending rearwardly substantially perpendicular to the face plate, as shown in FIG. 2, and a continuous flange 14 secured to or integral with the face plate and extending rearwardly substantially perpendicular thereto. Flange 14 is spaced inwardly of side edge 13 and is parallel thereto, thus forming a groove 15 around the entire periphery of the rear side of the face plate.

As shown in FIG. 3, it is preferred to provide an opaque border 16 surrounding the transparent viewing area 12 on the front side of face plate 10, and an opaque surface is also preferably provided on side edge 13, in order to mask the edges of pictures and/or indicia mounted behind the transparent viewing area 12, and groove 15. This opaque border and opaque side edge may be formed by etching or molding the surface of the face plate or by applying opaque paint or ink thereto. Alternatively, in the preferred practice where the face plate is a unitary structure formed by molding or casting a transparent resin, the mold may have an area corresponding to the border and side edge which will impart a frosted finish to the resin.

Figure 4:
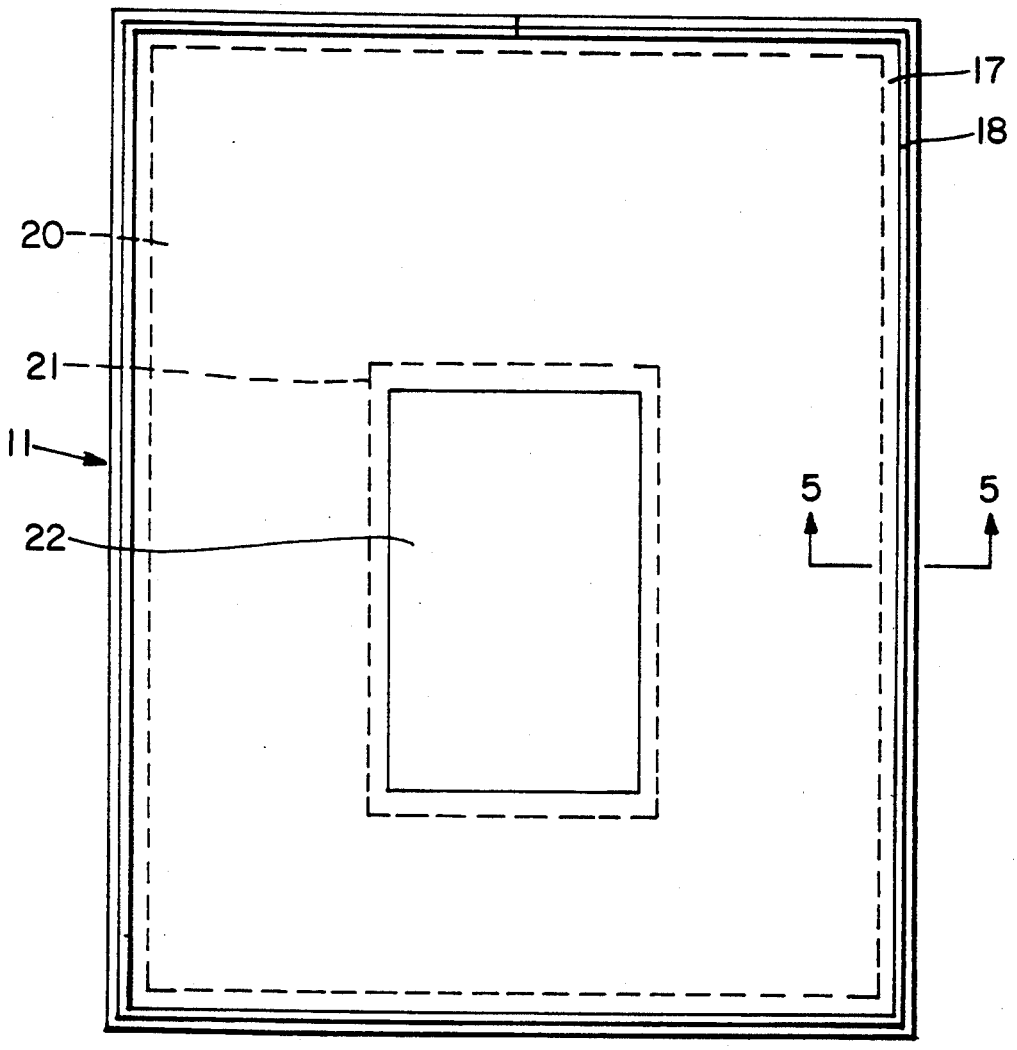
FIG. 4 is a front view of a back plate embodying the invention.
Figure 5:
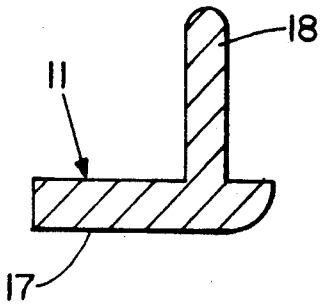
FIG. 5 is a fragmentary sectional view taken along the line 5—5 of FIG. 4.
Figure 6:
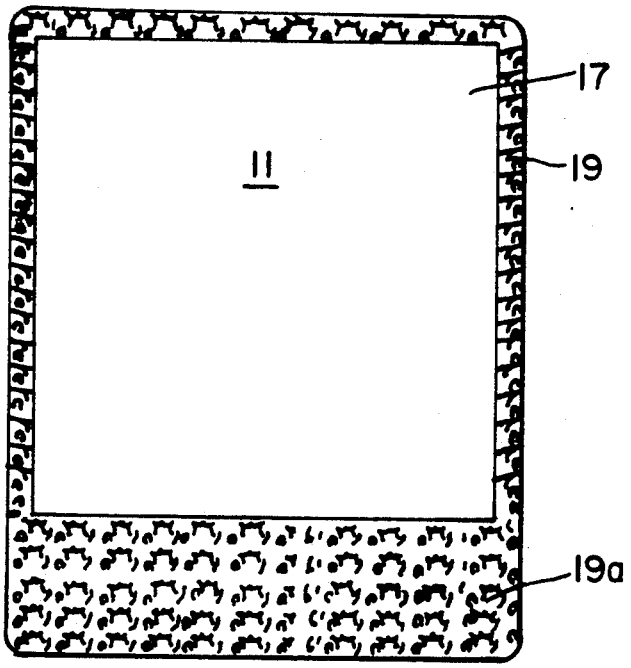
FIG. 6 is a rear view of a back plate embodying the invention.

Referring to FIGS. 4-6, back plate 11 comprises a planar viewing area 17 which is transparent, and a continuous tongue 18 extending forwardly substantially perpendicular to the back plate. The planar back plate 11 has the same dimensions as the face plate, and tongue 18 is spaced inwardly from the edge of back plate 11 a distance sufficient to provide a close mating engagement of tongue 18 in groove 15 around the entire periphery of the display frame when the face plate and back plate are placed in assembled relation. As shown in FIG. 6, the back plate is provided with an opaque border 19 which may be formed or applied in the same manner as described above for the border 16 of the face plate. The border at the lower edge of back plate 11 is preferably much wider than the border around the other edges, as shown at 19*a* in FIG. 6. The purpose of the wider border 19*a* is to mask the edges of a photograph or printed indicia mounted in the viewing area 17, and to provide an area for molding or imprinting decorations or names.

Figure 7:
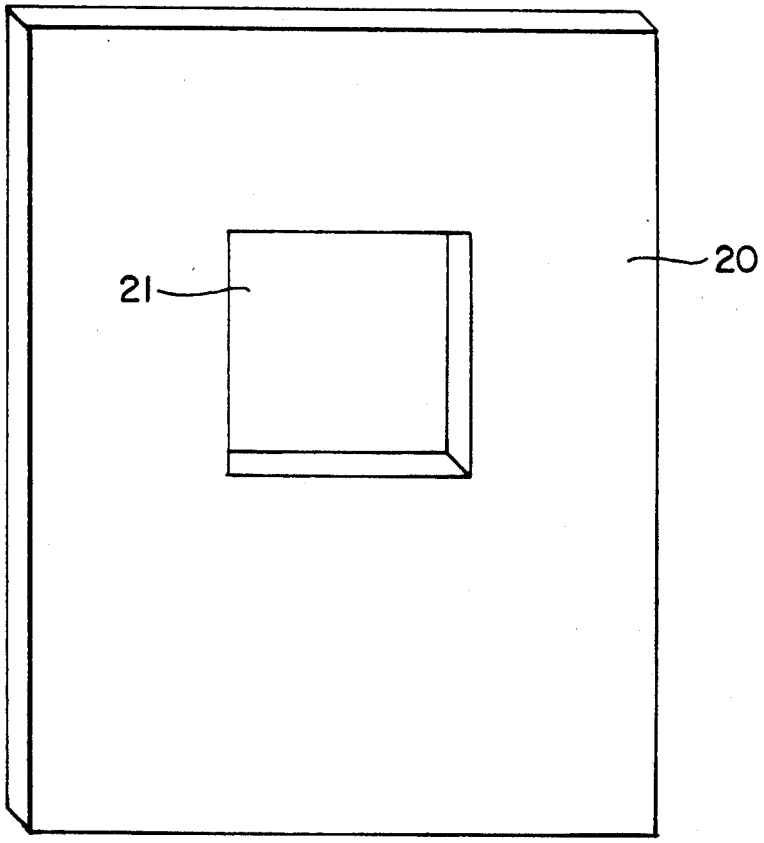
FIG. 7 is a perspective view of a spacer means in accordance with the invention.

Referring to FIG. 7, spacer means 20 is configured to fit between face plate 10 and back plate 11 when in assembled relation. Spacer means 20 has a cut-out opening 21 centrally thereof within which dessicant material 22 is placed (FIG. 4). Spacer means 20 is positioned as shown in broken lines in FIG. 4 so as to contact and retain a picture and/or indicia both against the viewing area of the face plate and the viewing area of the back plate. Spacer means 20 may be a molded resin material or a foamed plastic such as a polyethylene which does not retain moisture. Spacer means 20 is porous or provided with channels (not shown) so as to permit free communication of the dessicant material 22 with the sealed chamber. The dessicant material may be silica gel particles enclosed in a porous bag of fabric or paper, although other equivalent dessicant material may be substituted, such as gases designed for such a function.

In the preferred practice of the invention, face plate 10 is a unitary structure which may be formed by injection molding or casting a transparent resin having resistance against passage of ultraviolet light, high optical clarity and high impact resistance. Such a material is available commercially, and a suitable impact grade acrylic resin with ultraviolet light inhibitor is sold by Rohm and Haas under the designation "V 920". Other resin materials also may be used with varying degrees of opacity and clarity.

Back plate 11 is also preferably formed as a unitary structure by molding or casting a transparent resin of the same type as that used and described above for the face plate.

Assembly of the display frame of the invention is simple, requires no tools, and can be effected in about 10 minutes. A picture or photograph is placed against the transparent viewing area 12 of face plate 10, and another picture or printed indicia is placed in contact with the viewing area 17 of the back plate 11. Spacer means 20 is then placed over the picture or printed indicia on the back plate, and a bag of dessicant material 22 is placed in the compartment 21 provided therefor. A bead of adhesive 32 is then injected into groove 15 of face plate 10 around the entire periphery thereof. The back plate is then inverted and tongue 18 is inserted in groove 15 to provide a close mating engagement which is air-tight due to the adhesive and close fit of the mating parts. When the adhesive has set, the display frame assembly is completed.

An alternate form of assembly may be by high frequency vibration of the plastic molecular while in contact with each other. This method would probably be done by the distributor or manufacturer after contents were mailed or given to the manufacturer.

Figure 8:
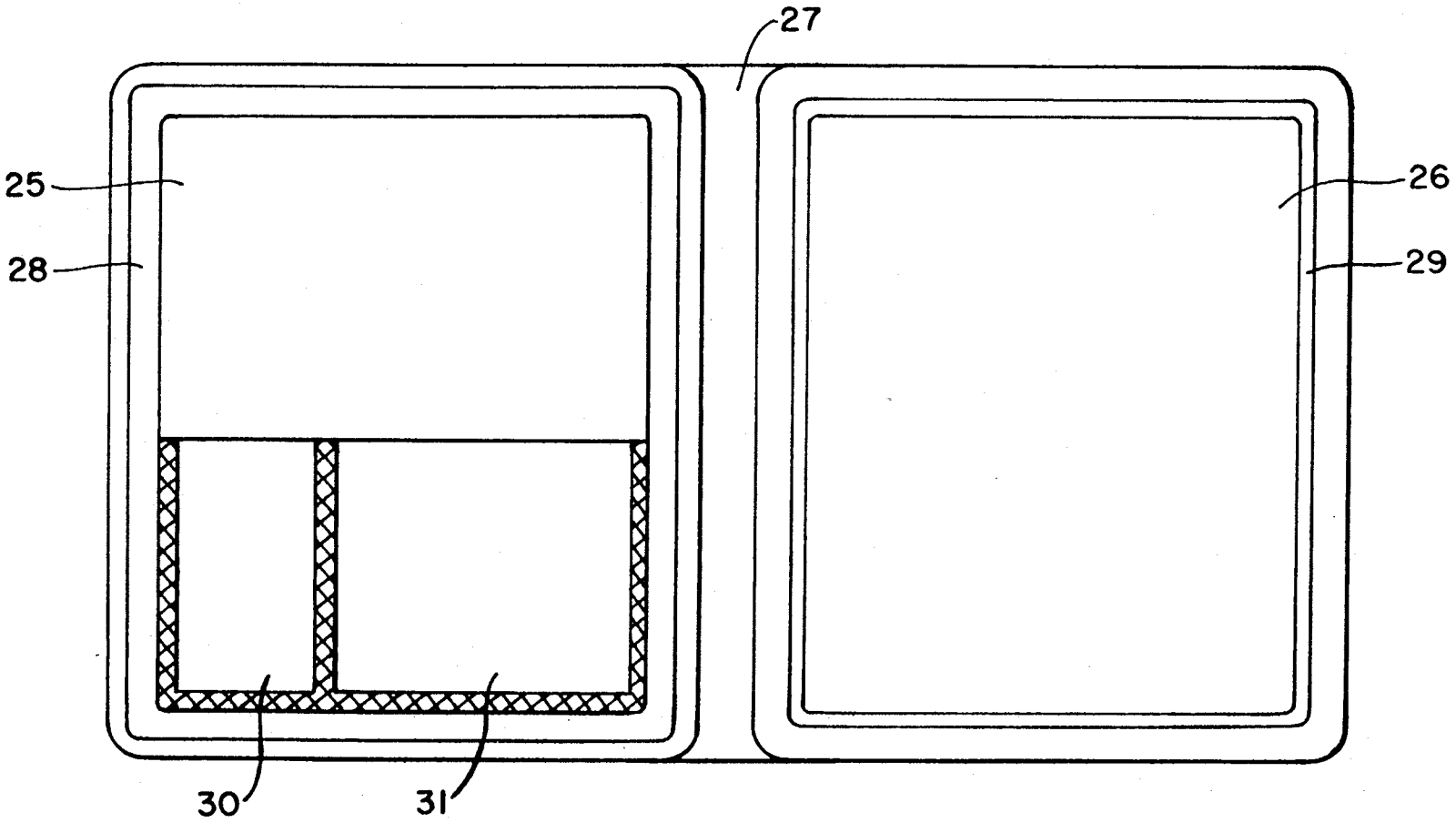
FIG. 8 is a plan view of a protective container in accordance with the invention.

Referring to FIG. 8, a protective container is illustrated which comprises a front half 25 and a back half 26 interconnected by a flexible web or hinge 27 which permits front half 25 to be folded over onto back half 26. A flange 28 is secured or formed integrally with front half 25 extending around all edges thereof and parallel thereto. A similar flange 29 is secured or formed integrally with back half 26 extending around all edges thereof and parallel thereto. The flanges 28 and 29 are so dimensioned that flange 29 will fit snugly within flange 28 when the two halves are folded together into mating relation. The height of the flanges 28 and 29 is such as to accommodate at least one display frame in each half.

Preferably one or more transparent pockets, as indicated at 30 and 31 are secured to the inner surface of front half 25 for insertion of a business or gift card, prayer card (when used by a funeral director), or other printed indicia as may be appropriate.

The protective container preferably is fabricated from a polyvinyl chloride or polyvinyl acetate resin having a suede-like finish on the exposed surfaces thereof while the inner surfaces may have a gloss, matte or textured finish. Any desired color or finish may be used, and it is preferred that the protective cover be opaque. The cover may contain embossings of printed names or designs.

While the invention been described in its preferred embodiments, modifications may be made without departing from the spirit of the invention, and no limitations are to be inferred other than as set forth in the appended claims.

I claim:

1. A display frame comprising a planar face plate having a transparent viewing area extending over a major portion thereof and a side edge extending rearwardly substantially perpendicular to said face plate, a continuous flange secured to said face plate and extending rearwardly substantially perpendicular thereto, said flange being spaced inwardly of said side edge and parallel thereto whereby to form a groove around the entire periphery of the rear side of said face plate; a planar back plate having the same dimensions as said face plate and having a continuous tongue extending forwardly substantially perpendicular to said back plate, said tongue being spaced inwardly from the edge of said back plate a distance sufficient to provide a mating tongue and groove engagement around the entire Periphery of said display frame when said face plate and said back plate are placed in assembled relation; adhesive material positioned in said groove whereby to form a sealed chamber directly behind said viewing area when said face plate and back plate are in assembled relation; and a desiccant material in communication with said sealed chamber.

2. The display frame claimed in claim 1, including a second transparent viewing area extending over a major portion of said back plate, and spacer means within said sealed chamber configured to hold a picture in contact with said viewing area of said face plate and to hold a picture or printed indicia in contact with said second viewing area of said back plate within said chamber and in communication with said desiccant material when said face plate and back plate are in assembled relation.

3. The display frame claimed in claim 2, wherein said spacer means includes a foamed or rigid plastic member extending parallel to the edges of said face plate and back plate, and dimensioned so as to contact and retain a picture and/or indicia in desired positions in contact with said face plate and said back plate when in assembled relation.

4. The display frame claimed in claim 2, including an opaque border surrounding said second transparent viewing area of said back plate, whereby to mask the edges of a picture or printed indicia mounted behind said second transparent viewing area.

5. The display frame claimed in claim 4, wherein said opaque border is formed by etching or molding the surface of said back plate, or by applying opaque paint or ink thereto.

6. The display frame claimed in claim 1, wherein said face plate and said back plate are rectangular or square, and said edge of said face plate extends continuously around all four edges thereof.

7. The display frame claimed in claim 1, including an opaque border surrounding said transparent viewing area of said face plate and an opaque surface on said side edge thereof, whereby to mask the edges of a picture mounted behind said transparent viewing area.

8. The display frame claimed in claim 7, wherein said opaque border is formed by etching or molding the surface of said face plate, or by applying opaque paint or ink thereto.

9. The display frame claimed in claim 1, wherein said face plate is a unitary structure formed by injection molding or casting a transparent resin having resistance against passage of ultraviolet light, high optical clarity and high impact resistance.

10. The display frame claimed in claim 1, wherein said back plate is a unitary structure formed by injection molding or casting a transparent resin having resistance against passage of ultraviolet light, high optical clarity and high impact resistance.

11. The display frame claimed in claim 1, including a protective container for said display frame having a dust tight closure, said container being formed of a vinyl resin having an opaque finish and being dimensioned to hold at least one display frame.

12. The display frame claimed in claim 11, wherein said protective container is provided with at least one transparent pocket secured to an inner surface thereof for display of indicia.

* * * * *

UNITED STATES PATENT AND TRADEMARK OFFICE

CERTIFICATE OF CORRECTION

PATENT NO. : 5,205,059

DATED : April 27, 1993

INVENTOR(S) : Jacob G. Doll

It is certified that error appears in the above—identified patent and that said Letters Patent is hereby corrected as shown below:

In Column 5, claim 1, line 35, delete "Periphery" and insert --periphery--

In column 6, claim 8, line 28, delete "7" and insert --4--

Signed and Sealed this

First Day of March, 1994

Bruce Lehman

BRUCE LEHMAN

*Commissioner of Patents and Trademarks*

*Attest:*

*Attesting Officer*